US005870115A

United States Patent [19]

Kikuchi et al.

[11] Patent Number: 5,870,115

[45] Date of Patent: Feb. 9, 1999

[54] INK-JET PRINTER WITH IMPROVED CAPPING MECHANISM

[75] Inventors: Hiroshi Kikuchi; Mitsuru Kishimoto; Noboru Ooishi; Masahiko Shimosugi; Shigenori Koido, all of Tokyo, Japan

[73] Assignee: Oki Data Corporation, Tokyo, Japan

[21] Appl. No.: 546,877

[22] Filed: Oct. 23, 1995

[30] Foreign Application Priority Data

Oct. 28, 1994 [JP] Japan ..... 6-265518

[51] Int. Cl.[6] ..... B41J 2/165

[52] U.S. Cl. ..... 347/32; 347/24

[58] Field of Search ..... 342/32, 29, 30, 342/19, 23, 44, 24

[56] References Cited

U.S. PATENT DOCUMENTS 5,164,748 11/1992 Katayanagi et al. ..... 347/30
5,592,034 1/1997 Felmus et al. ..... 307/130
5,608,432 3/1997 Yamguchi ..... 347/33

FOREIGN PATENT DOCUMENTS 0-362897 4/1990 European Pat. Off. ..... B41J 2/165
2-1325 1/1990 Japan ..... B41J 2/18

*Primary Examiner*—Benjamin R. Fuller
*Assistant Examiner*—Thien Tran
*Attorney, Agent, or Firm*—Panitch Schwarze Jacobs & Nadel, P.C.

[57] ABSTRACT

An ink jet printer has a print head mounted on a movable carriage. The print head prints by ejecting drops of ink. A cap is detachably mounted on the print head during non-printing periods. The cap moves together with the print head when the print head and the movable carriage move during the non-printing periods. The cap protects the print head by preventing accumulation of dirt and drying of ink. A cap holder detachably holds the cap. The cap holder carries the cap to the print head after printing ends, and carries the cap away from the print head before printing begins.

25 Claims, 6 Drawing Sheets

INK-JET PRINTER WITH IMPROVED CAPPING MECHANISM

BACKGROUND OF THE INVENTION

The present invention relates to an ink-jet printer, in particular to its capping mechanism.

An ink-jet printer has a printing head provided with a plurality of pressure chambers, to which ink is supplied from a cartridge. Pressure is created in the chambers by piezoelectric means, for example, or more commonly by heating the ink so that it partially vaporizes. The pressure ejects a drop of ink through a fine nozzle, thereby printing a pixel on a sheet of paper. To print a page, the print head moves back and forth on a movable carriage mounted on a shaft, ejecting drops on demand according to print data.

The diameter of the nozzles is typically no more than twenty to sixty micrometers (20–60 $\mu$m), so if the ink in the chambers were allowed to dry out during non-printing periods, the nozzles could easily become clogged with viscous or hardened ink. Accumulation of dirt (particles of dried ink, paper, etc.) around the nozzles can also cause clogging, or cause ink drops to be ejected in the wrong direction. These problems show up as printing defects such as missing or misplaced pixels.

To prevent these problems, an ink-jet printer is conventionally designed so that during non-printing periods, the print head moves to a parking station where it is covered by a cap. The print head normally remains capped while power is switched off. Many conventional printers are also designed, however, so that the carriage can be moved manually while power is off. If the carriage is thus moved, to facilitate the replacement of an ink cartridge for example, the operator may forget to move the carriage back to its parking station, so that the print head is left uncapped. Printing defects then appear when the printer is next used.

One way to keep the print head from being left inadvertently uncapped would to be provide a locking mechanism that holds the carriage at the parking station while power is off. This is not a desirable provision, however, because a person not knowing of the existence of the locking mechanism might attempt to move the carriage by force, resulting in damage to the printer.

SUMMARY OF THE INVENTION

It is accordingly an object of the present invention to prevent the print head of an ink-jet printer from being left inadvertently uncapped.

The invented ink-jet printer has a movable carriage, a print head mounted on the carriage, a cap holder, and a cap which can be detachably mounted on either the print head or the cap holder. During printing, the cap is mounted on the cap holder. At other times, the cap is mounted on the print head, and remains so mounted even if the carriage is moved manually. The cap protects the print head from dirt, and prevents ink from drying. The cap holder can be moved to carry the cap to and away from the print head.

DETAILED DESCRIPTION OF THE PREFERRED EMBODIMENTS

Embodiments of the invention will be described with reference to the attached illustrative drawings. These drawings are schematic, and are not necessarily drawn to scale.

Figure 1:
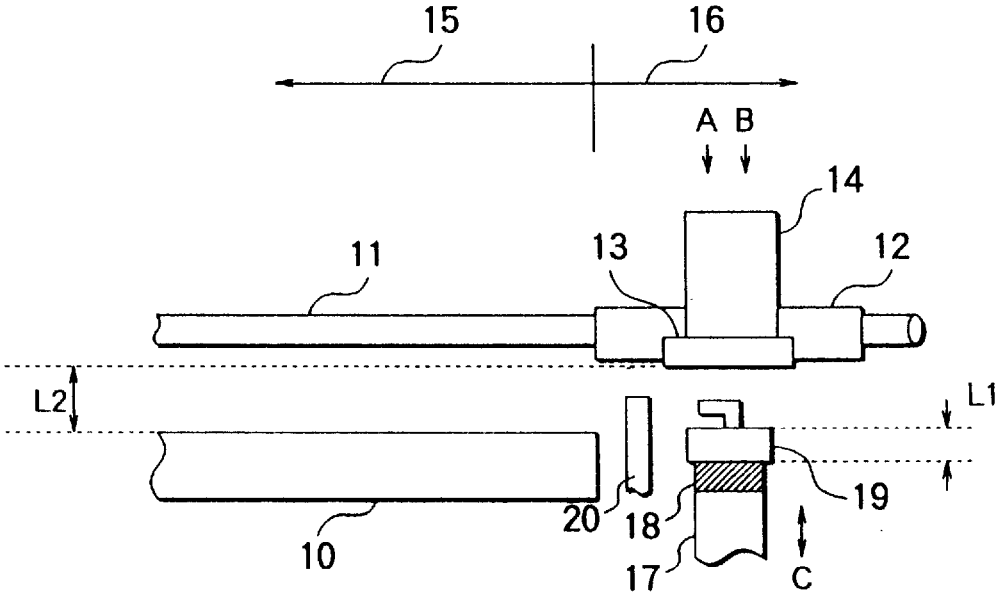
FIG. 1 is a schematic drawing of a first embodiment of the invention.

Referring to FIG. 1, the invented printer has a platen 10 for supporting paper or other printing media (not visible), and a shaft 11 on which a carriage 12 is movably mounted. A print head 13 and ink cartridge 14 are mounted on the carriage 12. The carriage 12 moves in the horizontal direction as indicated by the arrow at the top of the drawing, the range of travel of the carriage 12 being divided into a printing area 15 and a non-printing area 16. The letters A and B identify two positions of the carriage 12 in the non-printing area. Position B is the parking station, where the carriage 12 normally remains while the printer is not printing.

Disposed in the non-printing area 16 are a cap holder 17 with a magnetic tip 18 for holding a cap 19, and a cleaning blade 20. The magnetic tip 18 comprises, for example, a permanent magnet mounted at the end of the cap holder 17. The cap holder 17 can move back and forth in the direction of arrow C. The width L1 of the main body of the cap 19 is less than the space L2 between the platen 10 and print head 13, permitting the carriage 12 to move into the printing area 15 even when the cap 19 is attached to the print head 13. The clearance is preferably at least three-tenths of a millimeter, i.e., $$L2-L1 \geqq 0.3 \text{ mm.}$$

Figure 2:
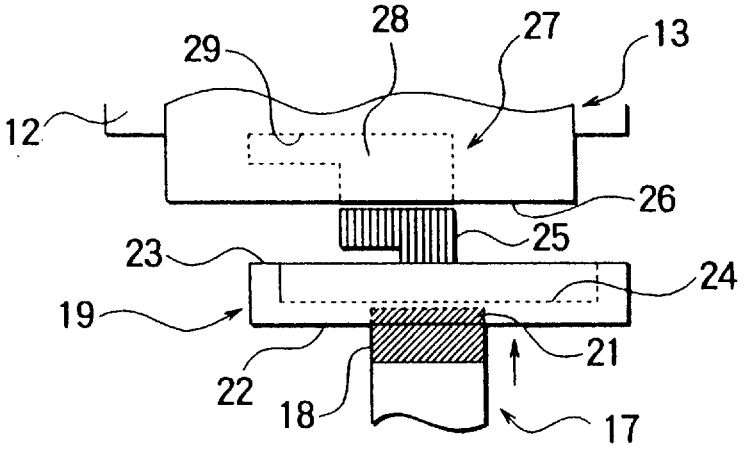
FIG. 2 shows an enlarged view of the cap holder and print head at the beginning of the capping sequence.

FIG. 2 shows an enlarged view of the print head and capping mechanism in the uncapped state, when the carriage 12 is at position A in FIG. 1. The magnetic tip 18 of the cap holder 17 is seated in a depression 21 in the rear surface 22 of the cap 19. In the front surface 23 of the cap 19 there is a somewhat larger cavity 24. The cap 19 also has an L-shaped member 25 which projects above the front surface 23.

The printing surface 26 of the print head 13 has an L-shaped cavity 27 adapted to receive the L-shaped member 25 of the cap 19. The L-shaped cavity 27 is larger than the L-shaped member 25, and consists of an entrance way 28 and side passage 29. The printing surface 26 of the print head 13 also has nozzles from which ink is ejected, although these nozzles are not visible in the drawing.

Figure 3:
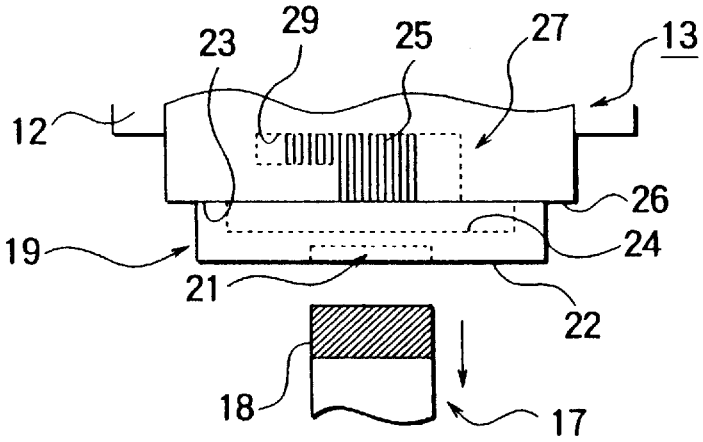
FIG. 3 shows an enlarged view of the cap holder and print head at the end of of the capping sequence.

FIG. 3 is a similar enlarged view showing the capped state, when the carriage 12 is at position B in FIG. 1.

Next, the operation of the first embodiment will be described.

Referring again to FIG. 1, when the printer receives data to be printed, the carriage 12 moves back and forth on the shaft 11 in the printing area 15, while the print head 13 ejects drops of ink, and the platen 10 scrolls the paper so as to print successive lines.

When all received data have been printed, if no further data are received within a certain time, the printer initiates a capping sequence. In this sequence, the carriage 12 moves from the printing area 15 toward position A in the non-printing area 16, where the cap holder 17 is holding the cap 19, and the cleaning blade 20 moves forward to meet the printing surface of the print head 13. As the print head 13 travels past the cleaning blade 20, rubbing contact is made, so that the cleaning blade 20 removes spattered ink and other dirt from the print head 13.

When the carriage reaches position A, the cleaning blade 20 retracts and the cap holder 17 moves in the direction of the arrow in FIG. 2, inserting the L-shaped member 25 into the entrance way 28 of the L-shaped cavity 27 in the print head 13. The carriage 12 them moves further, to position B in FIG. 1, so that the tip of the L-shaped member 25 is held in the side passage 29 of the L-shaped cavity 27, locking the cap 19 to the print head 13. During this motion the facing surfaces 23 and 26 of the cap 19 and print head 13 slide against each other.

When position B is reached, the cap holder 17 retracts as indicated by the arrow in FIG. 3, so that the magnetic tip 18 is withdrawn from the depression 21 in the rear surface 22 of the cap 19. This completes the capping sequence, and leaves the carriage 12 parked at the parking station B with the cap 19 locked to the print head 13.

In the capped state, the nozzles of the print head 13 face into the cavity 24 in the front surface 23 of the cap 19, and are thus covered by the cap 19. They are accordingly protected from dust and dirt, and the ink in the print head 13 does not dry out. If the printer's power is switched off, the print head 13 remains capped. While power is off, the carriage 12 can be moved manually without uncapping the print head 13, and without damage to the print head 13 or cap 19.

When power is switched on, regardless its current position, the carriage 12 is moved to its parking station (position B). When data to be printed are received, the cap holder 17 moves forward so that its magnetic tip 18 engages the depression 21 in the cap 19; then the carriage 12 moves to position A, unlocking the cap 19, and the cap holder 17 retracts, withdrawing the cap 19 from the L-shaped cavity 27 in the print head 13. With the print head 13 thus uncapped, the carriage 12 moves into the printing area 15 and starts printing. The cleaning blade 20 does not move forward during this uncapping sequence.

The advantage provided by the invention is that even if the operator moves the carriage 12 manually while power is off, to replace the ink cartridge 14 for example, and then fails to move the carriage 12 back to its parking station, the print head 13 will remain capped.

Figure 4:
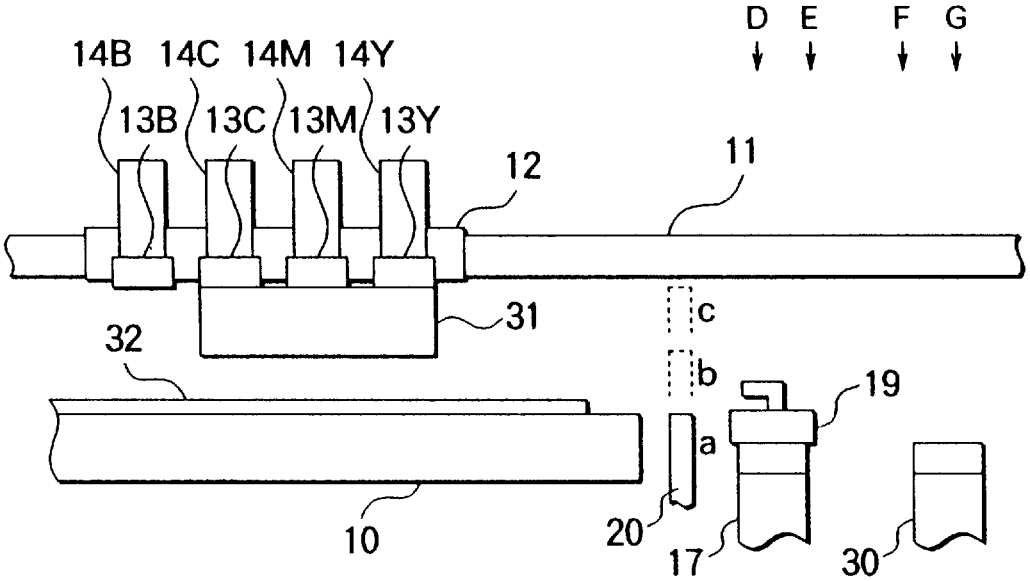
FIG. 4 is a schematic drawing of a second embodiment of the invention.

FIG. 4 illustrates a second embodiment of the invention, adapted for color printing. Elements equivalent to elements in FIGS. 1 to 3 are denoted by the same reference numerals.

The carriage 12 in FIG. 4 carries four print heads 13B, 13C, 13M, and 13Y, and four ink cartridges 14B, 14C, 14M, and 14Y. Print head 13B and ink cartridge 14B, which print with black ink, are equivalent to the print head 13 and ink cartridge 14 in the first embodiment. Print heads 13C, 13M, and 13Y print with cyan, magenta, and yellow ink, respectively, the ink being supplied from cartridges 14C, 14M, and 14Y.

The second embodiment has a first cap holder 17 and cap 19 which are used to cap the black print head 13B as in the first embodiment. In addition, a second cap holder 30 and cap 31 are provided for capping the cyan, magenta, and yellow print heads 13C, 13M, and 13Y. All three color print heads are capped by the single cap 31. FIG. 4 shows the state in which the color print heads 13C, 13M, and 13Y are capped and the black print head 13B is uncapped.

Next the operation of the second embodiment will be described.

For color printing, the first and second caps 19 and 31 are both removed from the print heads and held on their respective cap holders 17 and 30. When color printing ends, all four print heads 13B, 13C, 13M, and 13Y are cleaned by the cleaning blade 20, and both caps 19 and 31 are attached and locked to the print heads. The capping and uncapping operations for each cap are as described in the first embodiment. The printer may be adapted to move to, for example, positions D and E in FIG. 4 to cap the black print head 13B, and to positions F and G to cap the color print heads 13C, 13M, and 13Y. Position G is the parking station.

Alternatively, the capping operation may involve movement to only three positions D, E, and F. At position D, the first cap 19 is mated with the black print head 13B. The carriage 12 then moves to position E, locking the first cap 19 in place. At position E, the second cap 31 is also mated with the color print heads 13C, 13M, and 13Y. The carriage 12 then moves to position F, locking the second cap 31 in place. Position F is the parking station.

The second embodiment can also print in a black-only mode, commonly used for printing pages of text. In this mode, to protect the color print heads 13C, 13M, and 13Y from back-splatter of black ink from the paper 32, the color print heads 13C, 13M, and 13Y are left capped. Only the black print head 13B is uncapped to begin printing, and capped again when printing ends. The capping operation is the same as in the first embodiment, except for the operation of the cleaning blade 20.

During printing, the cleaning blade 20 is held at the retracted position (a) in FIG. 4. When the carriage 12 moves into the non-printing area after printing in black-only mode, first the second cap 31, which is protecting the color print heads 13C, 13M, and 13Y, moves past the cleaning blade 20. At this time the cleaning blade 20 is moved forward to an intermediate position (b) in which it makes rubbing contact with the second cap 19, thereby cleaning the surface of this cap. When the second cap 19 has passed the cleaning blade 20, the cleaning blade 20 moves fully forward to position (c), so that it can clean the black print head 13B as in the first embodiment.

The second embodiment provides the same advantage as the first embodiment: the print heads remain capped even if the carriage is moved manually while power is off. An additional advantage is that the color print heads are left capped during black-only printing, thereby preventing the colored inks from drying out during long text-printing jobs.

During printing in the black-only mode, back-splattered black ink and other dirt may adhere to the second cap 31, but this dirt is removed by the cleaning blade 20 when printing ends. Dirt accordingly does not accumulate on the second cap 31 to the extent that it might soil the paper 32.

Figure 5:
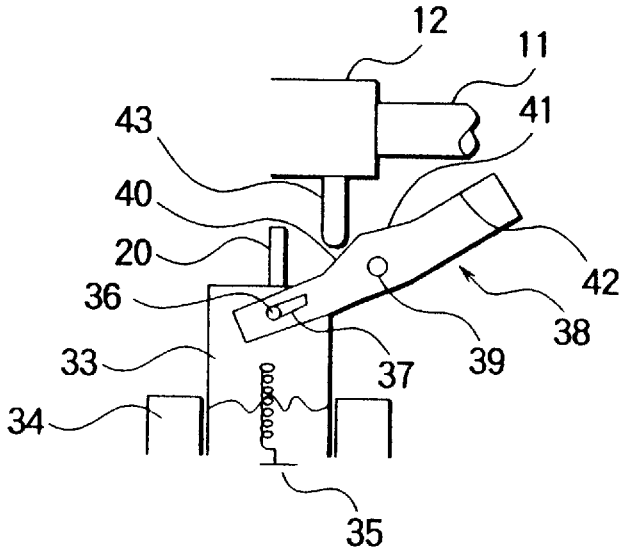
FIG. 5 shows the cleaning blade of the second embodiment in a retracted position.
Figure 6:
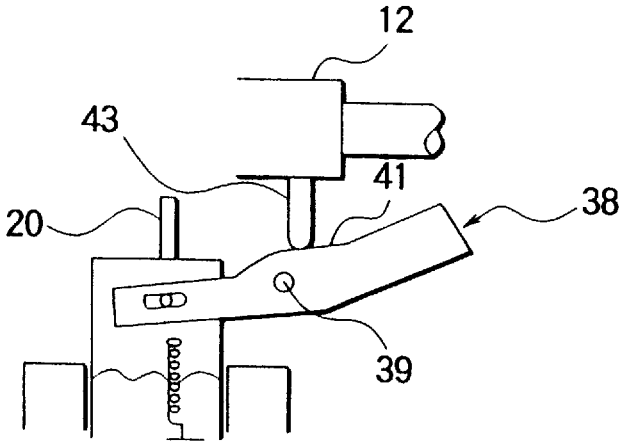
FIG. 6 shows the cleaning blade in an intermediate position.
Figure 7:
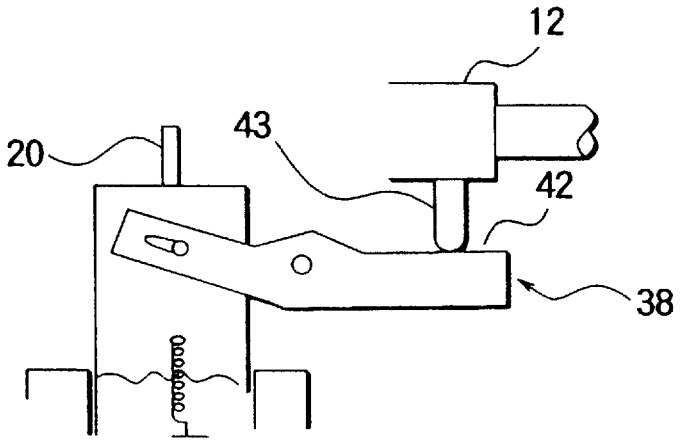
FIG. 7 shows the cleaning blade in a forward position.

FIGS. 5 to 7 show a preferred mechanism for moving the cleaning blade 20 in the black-only printing mode. The cleaning blade 20 is attached to a slider 33 that moves with respect to the printer frame 34. The slider 33 is normally held in a retracted position by a spring 35.

A pin 36 on the side of the slider 33 engages an oblong slot 36 in an armature 38 which pivots around a stationary shaft 39. The upper surface of this armature 38 comprises three flat sections 40, 41, and 42, which face a projecting member 43 attached to the carriage 12.

After printing in black-only mode, when the carriage 12 moves into the non-printing area, the projecting member 43 first makes contact with the second flat surface 41. As shown in FIG. 6, this contact forces the armature 39 to rotate on the shaft 39 so as to move the cleaning blade 20 to the intermediate position, for cleaning the cap covering the color print heads.

As the carriage 12 continues to move, the projecting member 43 travels along the second flat surface 41, holding the cleaning blade 20 in contact with the cap of the color print heads, until the projecting member 43 comes to the third flat surface 42. As shown in FIG. 7, the armature 38 is then forced to rotate further, moving the cleaning blade 20 to the fully forward position for cleaning the black print head.

After color printing, when the projecting member 43 first contacts the second flat surface 41, the armature 38 is turned further, by a mechanism not shown in the drawings, to permit the cleaning blade 20 to clean the color print heads. In this state the projecting member 43 begins by moving along the first flat surface 40 of the armature 38.

To control the armature 38 correctly, the projecting member 43 may be adapted to move in and out at appropriate points.

Figure 8:
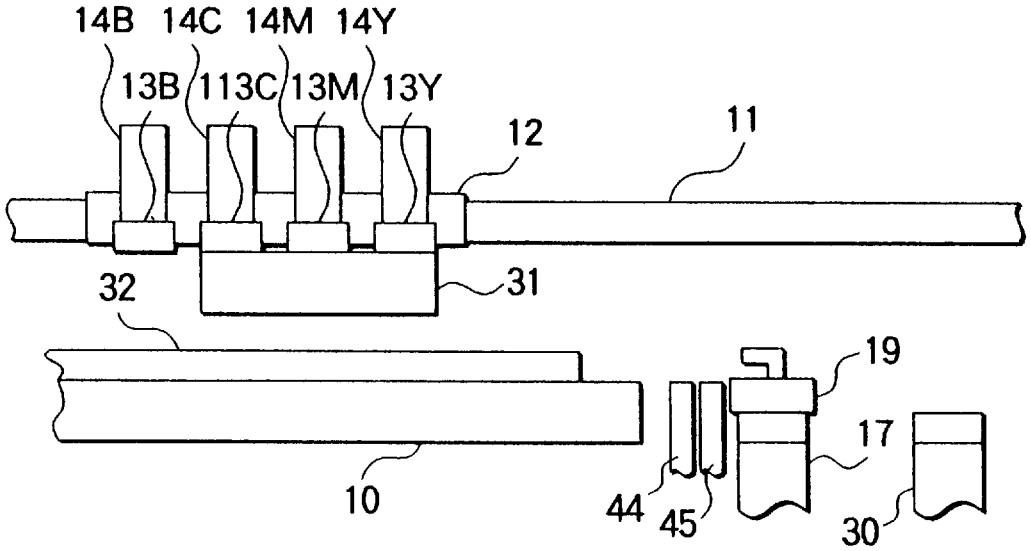
FIG. 8 is a schematic drawing of a third embodiment of the invention.

FIG. 8 shows a third embodiment of the invention, also adapted for color printing. Elements identical to elements in the second embodiment are designated by the same reference numerals.

The third embodiment has the same print heads and capping mechanism as the second embodiment, but has two cleaning blades 44 and 45. Cleaning blade 44 cleans the surfaces of all four print heads 13B, 13C, 13M, and 13Y. Cleaning blade 45 cleans the cap 31 that covers the color print heads 13C, 13M, and 13Y. Cleaning blade 45 is accordingly adapted to move forward to an intermediate position, while cleaning blade 44 is adapted to move fully forward.

A more detailed description of the third embodiment will be omitted. The third embodiment provides the same advantages as the second embodiment.

Figure 9:
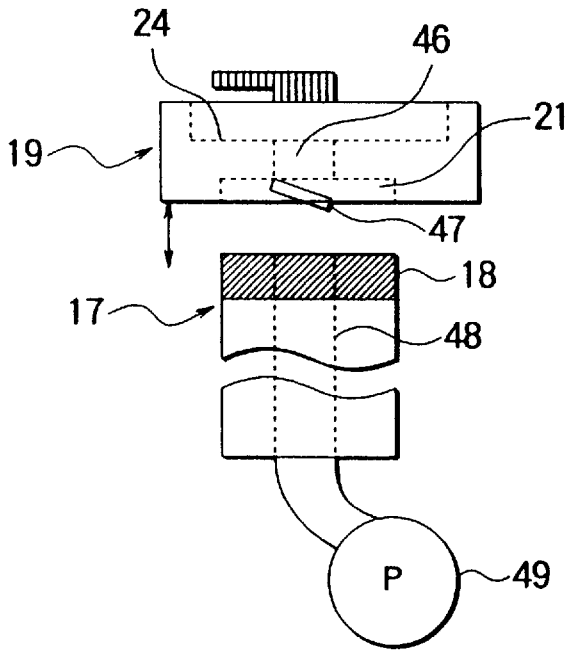
FIG. 9 illustrates a modification of the cap holder and cap.

FIG. 9 illustrates a modification that may be made to the cap holders and caps in the preceding embodiments. The same reference numerals are employed as in the first embodiment to designate the cap holder 17, cap 19, depression 21, and cavity 24. This modification can also be applied, however, to the second cap holder 30 and cap 31 in the second and third embodiments.

The cap 19 in FIG. 9 has a duct 46 leading from the depression 21 to the cavity 24. This duct 46 can be opened and closed by a valve 47. The cap holder 17 also has a duct 48, leading through the magnetic tip 18 to a suction pump 49.

When the cap holder 17 moves the cap 19 into contact with the print head and the cap 19 has been locked in place, before the cap holder 17 withdraws, the valve 47 is opened and the suction pump 49 is activated. The resulting suction draws any remaining bits of ink, paper, or dirt that still adhere to the print head out through the ducts 46 and 47. To complete the capping operation, the pump is stopped, the valve 47 is closed, and the cap holder 17 is withdrawn from the cap 19. The print head is then protected in the same way as before, the valve 47 preventing the intrusion of dust or dirt.

This modification has the advantage of removing dirt that might have been left behind by the cleaning blade.

Figure 10:
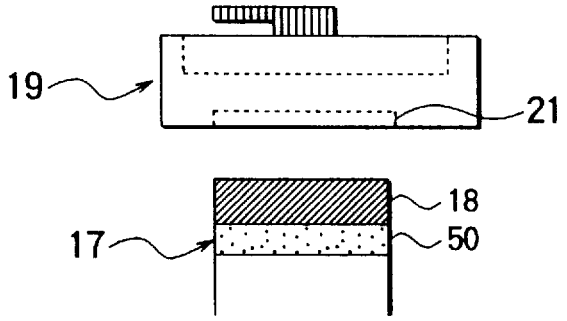
FIG. 10 illustrates another modification of the cap holder.

FIG. 10 illustrates another modification that can be made to any of the preceding cap holders 17 or 30. Reference numeral 17 is used in this drawing.

The cap holder 17 in FIG. 10 has an elastic layer 50 disposed just below the magnetic tip 18. When the cap holder 17 moves forward to retrieve the cap 19 from the print head, the elastic layer 50 permits the magnetic tip 18 to make flush contact with the base of the depression 21, even if the cap 19 is held at a slight angle to the cap holder 17. The elasticity thus helps the cap holder 17 recapture the cap 19 from the print head. The elasticity is also advantageous when the cap 19 is inserted into the L-shaped cavity in the print head and locked.

Figure 11:
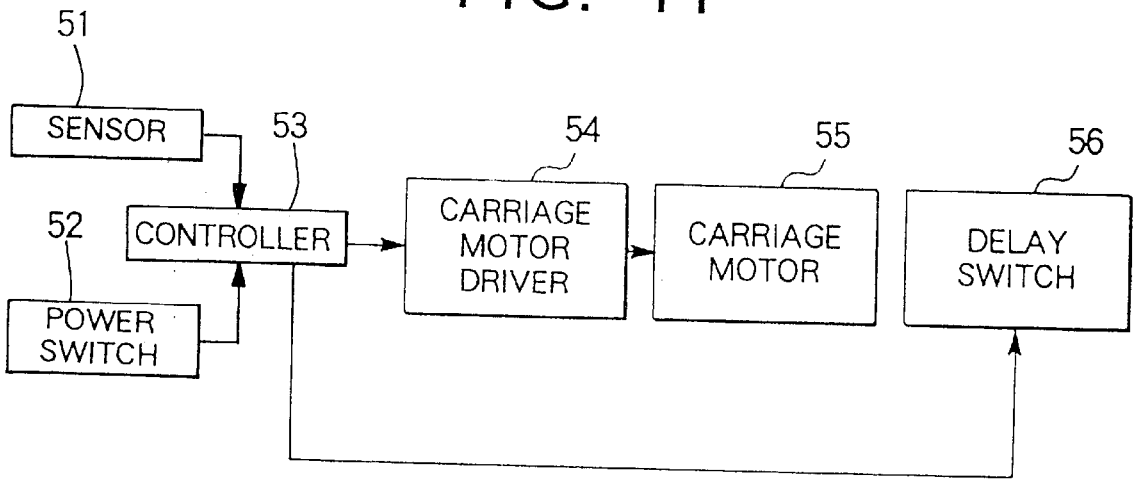
FIG. 11 is a block diagram of the invented printer's electrical system.

FIG. 11 is a block diagram showing components of the electrical system of the invented printer in any of the preceding three embodiments. The components illustrated are a sensor 51, power switch 52, controller 53, carriage motor driver 54, carriage motor 55, and delay switch 56.

The sensor 51 is, for example, a photodiode device that produces signals indicating whether the carriage is disposed at its parking station in the non-printing area, and if it is so disposed, whether all print heads are capped. The power switch 52 controls the printer's external power supply. The delay switch 56 controls an internal power supply such as a rechargeable battery. The carriage motor driver 54 drives the carriage motor 55, which moves the carriage 12. The controller 53 is a computing device that controls the printer generally; in particular, it responds to the states of the sensor 51 and power switch 52 and controls the carriage motor driver 54 and delay switch 56.

The operation of the printer's electrical system will be described with reference to the flowchart in FIG. 12.

Figure 12:
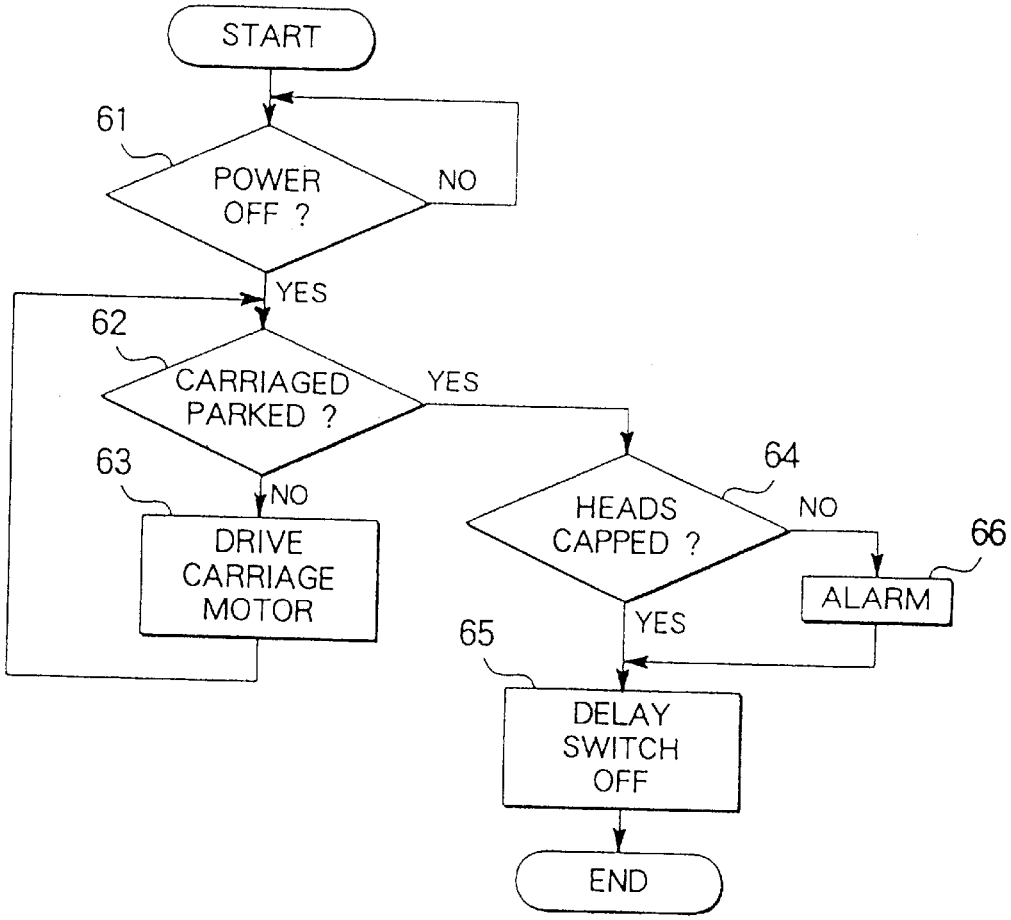
FIG. 12 is a flowchart illustrating the operation of the electrical system.

In step 61 in FIG. 12, the controller 53 monitors the state of the power switch 52. As long as the power switch 52 is switched on, the printer operates on its external power supply. When the power switch is switched off, the controller 53 initiates a power-off sequence in which the printer operates on internal power, supplied through the delay switch 56.

In the power-off sequence, the controller 53 monitors the state of the sensor 51 (step 62). If the sensor 51 indicates that the printer's carriage 12 is not at its parking station, the controller 53 commands the carriage motor driver 54 to drive the carriage motor 55 so as to move the carriage toward its parking station (step 63), and executes the capping sequence. If the carriage is not parked but some or all of the print heads are already capped, executing the capping sequence simply leaves those print heads in the capped state.

Steps 62 and 63 are repeated until the carriage is parked, as determined in step 62. The controller 53 then checks the sensor 51 to make sure that all heads are capped (step 64).

If the printing is operating normally, then whenever the carriage is at its parking station, all print heads will always be capped. In this case the controller 53 concludes the power-off sequence by turning off the delay switch 56 (step 65).

If, due to a printer malfunction, a print head is not capped, the controller 53 causes the printer to issue a warning alarm such as an electronic beep tone or an error message (step 66), before turning off the delay switch 56 in step 65.

The control sequence in FIG. 12 ensures that all print heads will be capped at power-off, even if the printer's power is switched off in the middle of a printing job, unless a malfunction occurs, in which case a warning is given. Together with the invented capping mechanism, this control sequence makes it substantially impossible for a print head to be left inadvertently uncapped.

The invention is not limited to the preceding embodiments and modifications. A color ink-jet printer, for example, may have a separate cap holder and cap for each print head, so that the color print heads do not have to share a common cap as in the second and third embodiments. This modification is useful when entire pages are printed in a single color other than black, because any one of the print heads can be uncapped while the others remain capped.

The head cleaning sequence, which was executed as part of the capping sequence, can also be executed independently. This permits the heads to be cleaned in response to a command from, e.g., the printer's control panel.

Instead of the elastic layer 50 in the cap holder in FIG. 10, the cap itself can be made, either partly or entirely, of an elastic material.

Those skilled in the art will recognize that still further modifications are possible without departing from the scope claimed below.

What is claimed is:

1. An ink jet printer comprising:

a movable carriage;

a print head containing ink mounted on said movable carriage, for ejecting drops of ink, thereby printing;

a cap detachably mounted on said print head during non-printing periods and moving together with the print head when the print head and the movable carriage move during the non-printing periods, the cap protecting said print head by preventing accumulation of dirt and drying of said ink; and a cap holder detachably holding said cap, carrying said cap to said print head after printing ends, and carrying said cap away from said print head before printing begins the cap being detached from the cap holder and remaining mounted on the print head when the print head and the movable carriage move during the non-printing periods.

2. The printer of claim 1, wherein said cap has an L-shaped member, and said print head has an L-shaped cavity, larger than said L-shaped member, for receiving said L-shaped member, thereby attaching said cap to said print head.

3. The printer of claim 1, comprising a cleaning blade for cleaning said print head.

4. The printer of claim 1, wherein said cap holder has a magnetic tip at an end thereof for holding said cap.

5. The printer of claim 4, wherein said cap holder has an elastic layer disposed below said magnetic tip, for facilitating contact between said magnetic tip and said cap.

6. The printer of claim 1, wherein said cap comprises an elastic material.

7. The printer of claim 1, wherein said cap has a first duct and said cap holder has a second duct, said printer also comprising:

a suction pump for drawing dirt from said print head out through said first duct and said second duct, when said cap is mounted on said print head and said cap holder is in contact with said cap.

8. The printer of claim 7, wherein said cap also has a valve for opening and closing said first duct.

9. The printer of claim 1, further comprising a plurality of print heads for printing in different colors, a plurality of caps for protecting said print heads, and a plurality of cap holders for holding respective caps.

10. The printer of claim 9, wherein said plurality of print heads comprises a print head for printing with black ink, and a plurality of other print heads for printing with other colors, and said plurality of caps comprises:

a cap for protecting said first print head for printings with black ink; and a second cap for protecting all of said other print heads printing with other colors.

11. The printer of claim 10, comprising a movable cleaning blade having a first position and a second position, the cleaning blade in the first position for cleaning said print head for printing with black ink and said other print heads, and in the second position for cleaning said second cap while the second cap is mounted on and is protecting the other print heads.

12. The printer of claim 10, comprising:

a first cleaning blade for cleaning said print head for printing with black ink and said other print heads for printing with other colors; and a second cleaning blade for cleaning said second cap while the second cap is mounted on and is protecting the other print heads.

13. A method of protecting a print head of an ink-jet printer during non-printing periods, comprising the steps of:

providing a parking station in a non-printing area;

moving said print head to said parking station in said non-printing area after completion of printing;

attaching and locking a cap to said print head, so that said cap remains attached to said print head even if said print head is moved out of the non-printing area;

moving said print head to said parking station before initiation of printing;

removing said cap from said print head; and holding said cap in said non-printing area during printing.

14. The method of claim 13, wherein said cap has an L-shaped member, said print head has an L-shaped cavity larger than said L-shaped member, and said step of attaching and locking comprises:

moving said print head to a first position;

inserting said L-shaped member into said L-shaped cavity; and moving said print head to said parking station, thereby locking said L-shaped member in said L-shaped cavity.

15. The method of claim 13, comprising the further step of cleaning said print head before attaching said cap to said print head.

16. The method of claim 15, wherein said cap has a duct, and cleaning said print head comprises applying suction through said duct.

17. The method of claim 13, wherein said printer normally operates on an external power supply, comprising the further steps of:

operating said printer on an internal power supply when said external power supply is turned off;

checking whether said print head is disposed at said parking station;

if said print head is not disposed at said parking station, moving said print head to said parking station, and attaching and locking said cap to said print head and switching off said internal power supply.

18. The method of claim 17, comprising the further step of issuing an alarm before switching off said internal power supply, if said print head is disposed at said parking station but said cap is not attached to said print head.

19. A method of protecting print heads of a color ink-jet printer, comprising the steps of providing at least two caps for capping said print heads,:

attaching at least said two caps to said print heads, thereby covering all of said print heads, upon completion of printing;

locking said caps to said print heads so that said caps remains attached to said print heads if said print heads are moved; and removing at least one of said caps from at least one of said print heads, before commencement of printing.

20. The method of claim 19, wherein said print heads comprise a print head for printing with black ink, and a plurality of other print heads for printing with other colors, wherein the attaching step comprises:

attaching a cap to the print head for printing with black ink to cover same; and attaching a second cap to the other print heads for printing with other colors to cover same.

21. The method of claim 20, comprising further a step of cleaning said print head for printing with black ink and said other print heads after color printing.

22. The method of claim 20 wherein, during printing with black ink only, the method comprises the further steps of removing the first cap from the print head for printing with black ink and covering the other print heads for printing with other colors with the second cap.

23. The method of claim 20, further comprising a step of cleaning said print head for printing with black ink and said second cap after printing with black ink only.

24. The method of claim 19, wherein the attaching step comprises attaching a separate cap to each print head.

25. The method of claim 22 further comprising the step of moving all the print heads together during printing.

* * * * *